US006572709B1

(12) United States Patent
Kaneda et al.

(10) Patent No.: US 6,572,709 B1
(45) Date of Patent: Jun. 3, 2003

(54) ULTRASONIC CLEANING METHOD

(75) Inventors: Sotaro Kaneda, Hokkaido (JP); Naonobu Sasada, Hokkaido (JP); Robert D. Varrin, Jr., Reston, VA (US); Michael W. Rootham, Delmont, PA (US)

(73) Assignee: Dominion Engineering, Inc., Reston, VA (US)

( * ) Notice: Subject to any disclaimer, the term of this patent is extended or adjusted under 35 U.S.C. 154(b) by 0 days.

(21) Appl. No.: 09/567,722

(22) Filed: May 10, 2000

Related U.S. Application Data

(60) Provisional application No. 60/143,727, filed on Jul. 14, 1999, and provisional application No. 60/133,693, filed on May 10, 1999.

(51) Int. Cl.[7] ..... B08B 7/02

(52) U.S. Cl. ..... 134/1; 134/22.12; 134/22.18; 134/14; 134/22.19; 134/24; 134/166 R; 134/184

(58) Field of Search ..... 134/1, 22.12, 22.18, 134/24, 166 R, 184, 14

(56) References Cited

U.S. PATENT DOCUMENTS 4,320,528 A * 3/1982 Scharton et al. ..... 134/1
4,375,991 A * 3/1983 Sachs et al. ..... 134/1
4,595,419 A * 6/1986 Patenaude ..... 134/1
4,879,089 A * 11/1989 Kenworthy et al. ..... 376/399
6,290,778 B1 * 9/2001 Zugibe ..... 134/1

* cited by examiner

*Primary Examiner*—Randy Gulakowski
*Assistant Examiner*—M. Kornarov
(74) *Attorney, Agent, or Firm*—Pillsbury Winthrop LLP

(57) ABSTRACT

An ultrasonic cleaning method for cleaning the film, scale and sludge from internal surfaces of tubes, tubesheets, tube support plates and channel heads of steam generators previously exposed to water or steam at temperatures of more than 200° C. introduces an ultrasonic transducer or transducer array into the steam generator and submerges the ultrasonic transducer and the surface to be cleaned in water or aqueous solution. Ultrasonic energy is introduced into the water at a power level of 20 watts/gallon or more and at frequencies of from 10 to 200 KHz. An array of transducers is employed to introduce 20 to 60 watts/gallon of water or more into the steam generator. In one practice, the transducer or transducer array is suspended in the steam generator. An array of transducers can be assembled (and later disassembled) in situ where individual transducers or small transducer subassemblies must introduced into the steam generator through small hand holes or other small diameter nozzles. In another practice, the ultrasonic transducer is moved through the water while introducing the ultrasonic energy into the water. Large amounts of ultrasonic energy can be introduced into the water and the energy nodes moved through the water so that the energy can efficiently penetrate into the interior rows of tubes and other internal structures.

20 Claims, 2 Drawing Sheets

ULTRASONIC CLEANING METHOD

CROSS-REFERENCE

This application is entitled to the benefit of U.S. Provisional Patent Application No. 60/133,693, filed May 10, 1999, and U.S. Provisional Patent Application No. 60/143,727, filed Jul. 14, 1999.

BACKGROUND OF THE INVENTION

The invention relates to an ultrasonic cleaning method for cleaning films, scales and sludge deposits from surfaces of assemblies after their exposure to high temperature water or steam and, more particularly, to a method for cleaning the surfaces of industrial process vessels such as shell and tube heat exchangers and the like.

Metallic surfaces exposed to water or aqueous solutions over long periods of time in closed heat transfer systems tend to develop films or scales and/or become covered by sludge regardless of the system purity levels. Thus, for example, in commercial electric power generating plants, after several months of on-line operation at high temperatures of 200° C. or more, large vessels such as shell and tube heat exchangers commonly known as steam generators tend to develop adherent films, scales and/or sludge deposits on the surfaces of tubes, tubesheets, tube support plates and other internal structural parts even though the purity of the water may be controlled to the parts per million level or lower. These films, scales and sludge will after a period of time have an adverse affect on the operational performance of the steam generators. Also, in pressurized water nuclear power plants for generating commercial electric power, radioactive films tend to develop on the internal surfaces of channel heads of steam generators or other primary system components even though the purity of the pressurized water is controlled at the parts per billion level. Undesirably, such radioactive films may raise background radiation levels in a plant.

Various off-line cleaning methods have been developed to remove the films, scales and sludges which have built up on the internal surfaces of heat exchangers which generate steam. Commercially successful methods include: pressure pulsing with shock waves; water slapping; chemical cleaning; sludge lancing; use of scale conditioning agents; and/or flushing with very large volumes of water. However, these off-line methods, including setup and various other auxiliary operations, invariably require long periods of time on critical path schedules to remove adherent films, scales and sludges which buildup on tube surfaces near to tubesheets and tube support sheets. Also, adherent scales which develop in annular crevices between tube external surfaces and tube support plates and siliceous sludge piles which buildup on tubesheets have proven to be especially difficult to remove. Thus, residual amounts of adherent scale and sludge which can not be removed are permitted to remain on the internal surfaces of the steam generators at the end of a commercial cleaning step, which reduces the effectiveness of the cleaning operation. The residual scale and sludge problem is compounded by an industry trend toward ever faster refueling outages, which limits the window of time available for cleaning operations.

Accordingly, the power generation industry and its suppliers have long searched for practical methods which will more effectively attack adherent films, scales and/or sludges built up on the internals of steam generators. Thus, about twenty years ago (when U.S. Pat. No. 4,320,528 was filed) or more, it was proposed to employ ultrasonics alone or in connection with known chemical cleaning compositions in commercial nuclear reactor systems in order to remove the buildup of corrosion, oxidation and sedimentation on tubes, tubesheets and tube support plates of steam generators. However, ultrasonic techniques have not heretofore proven to be commercially satisfactory for cleaning the many interior rows of closely spaced, small diameter tubes extending from tubesheets and support plates on the secondary (or shell) side of steam generators. According to U.S. Pat. No. 4,645,542, the placement of transducers in the steam generators in accordance with the practice of U.S. Pat. No. 4,320,528 requires considerable time, effort and expense. Also, in some cases it is necessary to cut away a portion of the steam generators, which many owners are reluctant to do (according to the patent).

SUMMARY OF THE INVENTION

It is an object of the present invention to provide an effective method for ultrasonically cleaning adherent films, scales and sludges from assembly surfaces previously exposed to water or steam at temperatures of 200° C. or more. It is a further object to provide a commercially effective cleaning method.

With these objects in view, the present invention resides in ultrasonic cleaning method, including the steps of: introducing an ultrasonic transducer into a vessel containing an assembly having a surface which was previously exposed to water or steam at temperatures of 200° C. or more and has at least part of its surface covered by a film, scale or sludge; submerging the ultrasonic transducer and at least a portion of the surface in a liquid; and generating ultrasonic energy at a power level of at least about 20 watts per gallon at the external surface of the transducer in contact with the liquid and at a frequency of from about 10 KHz to about 200 KHz for introducing the ultrasonic energy into the liquid. In a preferred practice, the energy is generated at a power level of at least about 10 watts/inch$^2$. Most preferably, an array of transducers is employed to output at least 20 to 60 watts per gallon (5–16 watts/liter) of liquid in the vessel. Advantageously, the films, scales and sludges are disrupted without generating large vibrations in the assembly or otherwise structurally damaging the assembly in the course of the cleaning operation. Also, although some large particles may break off the film, scale and sludge, the intense energy tends to produce small particulates which have long settling times in the turbulent liquid flowing in the vessel so that the particulates may be transported away from the surface of the assembly to, e.g., external filter systems where the particulates can be separated from the liquid, and the filtered liquid then recirculated to the surface.

In a preferred practice of the present invention, an ultrasonic transducer or an array of transducers may be introduced into a vessel and suspended in the vessel (and then detached after the cleaning operation). Thus, for example, the transducer or a chain of transducers may be suspended from a tube support plate within the secondary side of a steam generator and hang into a tube bundle. The chain may hang down to the region above the upper surface of the next lower tube support plate or may hang through flow slots in the tube support plates to the region above a more remote tube support plate or even down to the region above the tubesheet. On the primary side of a steam generator, a transducer or transducer chain may be suspended from the tubesheet and hang into a channel head. In a variation of this practice, a transducer or transducer chain may remain in the steam generator during on-line power operations instead of being introduced and removed from the steam generator at the beginning and end of a cleaning operation. Advantageously, large arrays of transducers may be assembled (and later disassembled) in situ in the vessel from smaller subassemblies of transducers which will fit through relatively small nozzles in the vessel. In a similar practice, the transducer or transducer chain may be introduced into a vessel and supported by a removable support assembly instead of by the vessel.

In another preferred practice of the present invention, an ultrasonic transducer or an array of transducers is introduced into a vessel; and the ultrasonic transducer or transducer array and at least a portion of assembly is submerged in a liquid. Ultrasonic energy is then introduced into the liquid by the transducer or transducer array, the transducer or transducer array is moved, and ultrasonic energy is again introduced into the liquid by the transducer or transducer array. Advantageously, the high energy nodes of the ultrasonic transducer or the high energy nodes of the ultrasonic transducer array can be moved through the liquid and clean remote surfaces such as the interior rows of tubes and surrounding area in the assembly. In this practice, the transducer or transducer array may move through the liquid at a speed of about 0.1 inch/minute (2.5 mm/min) or faster while simultaneously introducing energy into the liquid. In other operations, the transducer or transducer array may move through the liquid only between waves.

In preferred commercial practices of the present invention, the cleaning liquid is water or a dilute aqueous solution containing cleaning agents or scale conditioning agents.

BRIEF DESCRIPTION OF THE DRAWINGS

The invention as set forth in the claims will become more apparent from the following detailed description of a preferred embodiment thereof shown, by way of example only, in the accompanying drawings, wherein:

DESCRIPTION OF THE PREFERRED EMBODIMENT

Figure 1:
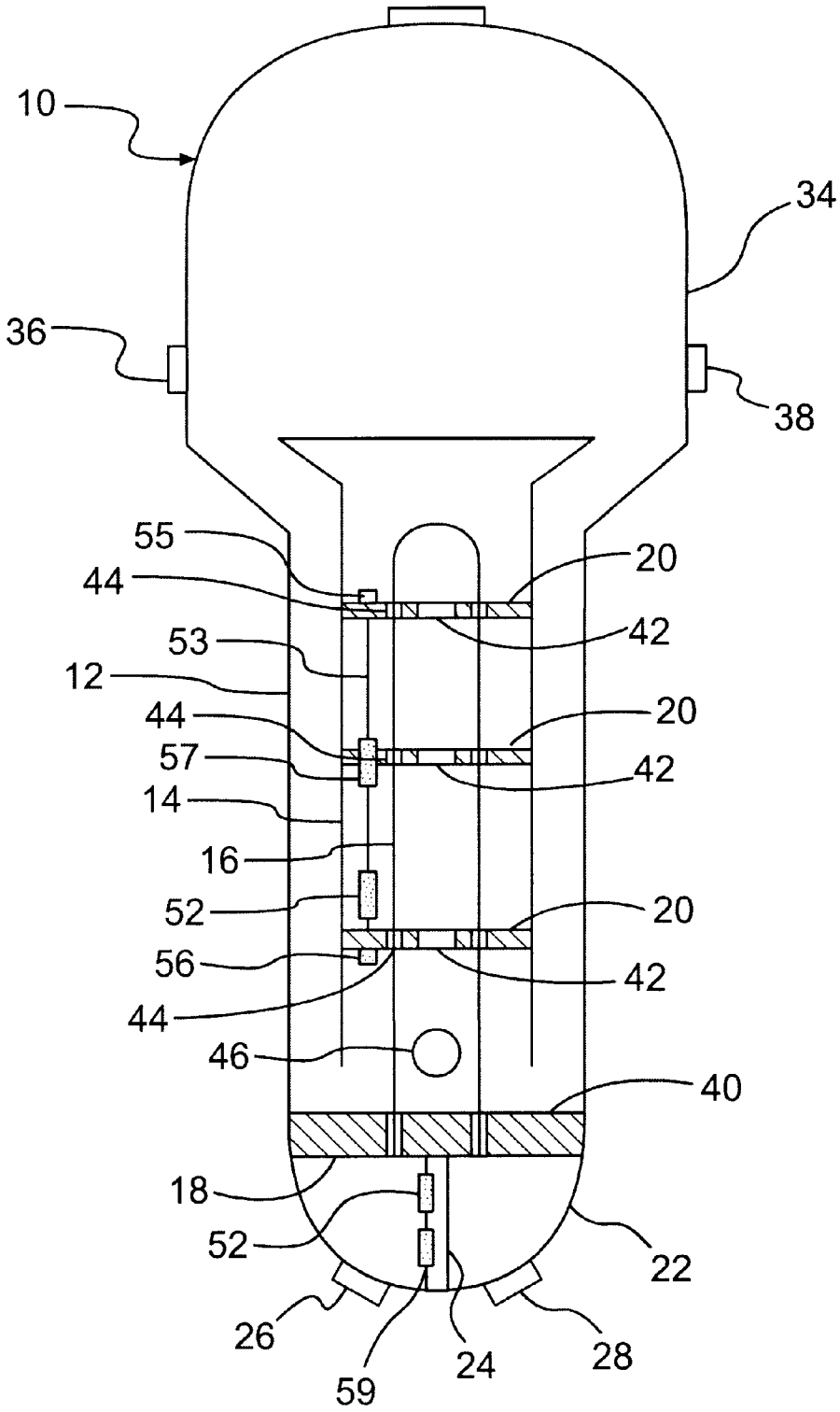
FIG. 1 is a schematic representation of a steam generator which may be cleaned in the practice of the present invention.

Referring now to the drawings in detail and in particular to FIG. 1 there is shown a steam generator 10 of the type employed in commercial pressurized water nuclear reactors for generating electric power. The steam generator 10 has a lower cylindrical section 12 with a substantially concentric wrapper 14 containing a U-tube bundle (comprising thousands of tube represented by tube 16) extending vertically from a tube sheet 18 and through a plurality of tube support plates 20. In another steam generator design, a straight tube bundle (not shown) may be provide in a lower cylindrical section. A channel head 22 welded to the tubesheet 18 has an internal divider plate 24 dividing the channel head into two sections, including a hot leg section 26 for receiving hot coolant (typically high pressure water containing small amounts of boron and lithium) from a reactor vessel (not shown) and a cold leg section 28 for returning relatively cooler coolant to the reactor vessel. The steam generator 10 has one or more small diameter (six inch diameter or less) nozzles 46 near the bottom of the tube bundle for servicing and inspecting the tubes 16 and tubesheet 18. In addition, steam generators may have similar nozzles (not shown) higher up on the lower cylindrical section for servicing and inspecting the tube support plates and other internal structures in the upper bundle region. The steam generator 10 has an upper section 34 with an inlet nozzle 36 for receiving feedwater from a turbine-generator for generating electric power and outlet nozzle 38 for returning steam to the turbine-generator. Other steam generators are of the horizontal design wherein the tube bundle is oriented horizontally rather than vertically as shown in FIG. 1. The cleaning method described herein is equally applicable to such designs.

During on-line power generation operations, the feedwater enters a steam generator 10, mixes with recirculating water in the upper cylindrical section 34, generally flows downwardly through an annulus formed by the lower cylindrical section 12 and the wrapper 14 and turns upwardly in the region between the bottom of the wrapper 14 and the upper surface 40 of the tubesheet 18. A major portion of the water then flows upwardly through four to six or more flow slots 42 in each of the tube support plates 20 and along the tubes 16 as steam is generated at the tube surfaces. Another portion of the recirculating water flows in parallel through annular crevices 44 between the tubes 16 and the tube support plates 20 to the extend that the crevices are not blocked by scale and/or sludge. A two phase mixture of steam and water then flows from the lower cylindrical section 12 into the upper cylindrical section 34. The generated steam separates from entrained water in separators and dryers (not shown) in the upper cylindrical section 34 of the steam generator 10 and then flows out the outlet nozzle 38. The tube side of the steam generators normally operate at pressures up to about 155 bar (2250 psi) or more and at temperatures up to about 340° C. (650° F.) or more. The shell side of the steam generators normally operate at pressures up to about 63 bar (920 psi) or more and at temperatures up to about 280° C. (540° F.) or more.

Such commercial power generating plants are operated on-line and continuously generate electric power for about one to two years and then are taken off-line on scheduled outages for refueling and simultaneously for plant maintenance and inspections. During the on-line periods when high pressure, high temperature steam is generated on the shell sides of steam generators 10, films and scales tend to buildup on the external tube surfaces, especially in the area just above the tubesheets 18 and the tube support plates 20. Particularly adherent scales tend to buildup in the crevices 44 between the tubes 16 and the tube support plates 20. Also, sludge deposits tend to build up in the central areas of the upper surfaces 40 of the tubesheets 18 and, to a lesser degree, on the upper surfaces of the tube support plates 20. Later, during the refueling outages, the secondary side of the steam generators may be cleaned by pressure pulsing or by one of the other above-mentioned commercial methods depending upon the nature of the fouling problem and the time available for cleaning. Also, on the tube side of steam generators, radioactive films on the channel heads or on the surfaces of attached system components such as reactor coolant pumps (not shown) may be cleaned by one of several commercial methods (e.g., by a combination of permanganate treatments with either citric acid-oxalic acid treatments or low oxidation state metal treatments) to reduce background radiation levels.

In the ultrasonic cleaning method of the present invention, an ultrasonic transducer or an array of transducers (represented by ultrasonic transducer 52 of FIG. 2) may be introduced through small nozzle 46 into steam generator 10 or one of the upper small diameter nozzles (not shown)

along the upper bundle area. The ultrasonic transducer 52 may be a radial push pull transducer having a resonator rod with generators (also known as ultrasonic converters) on either end of the type manufactured by Martin Walter Ultraschalltechnik GmbH of Straubenhardt, Germany, which is the subject of U.S. Pat. No. 5,200,666, and which patent is hereby incorporated by this reference for its disclosure of structure of a radial transducer. These transducers 52 can output up to about 1000 watts or more. Effective radial transducers for disrupting certain adherent scales on commercial steam generators operate at 25 KHz have a diameter of 50 to 70 mm and a length of about 70 mm. Preliminary testing has shown that such transducers can loosen scale collars on tubes which can not be removed by chemical cleaning. Other radial transducers which have a diameter of from 40 to 50 mm and a length of about 60 mm may be operated at 40 KHz to attack particularly adherent films, scales and sludges. These transducers may be operated to output 10 watts/inch$^2$ (1.5 watts/cm$^2$) or more at their external surfaces into the surrounding liquid. Other transducers may operate 20 KHz or even lower and produce surface energy densities of 5 watts/cm$^2$ or more. For example, high power transducers that can deliver 4000 watts may be employed. Arrays of such radial transducers may be assembled from a first row of two or more axially aligned transducers spaced apart by about the length of a transducer with an adjacent, parallel second row of similarly spaced transducers positioned adjacent the spans between the transducers in the first row. Preferably, the total energy input to the liquid is on the order of about 20 to 60 watts/gallon or more. A preferred practice, the range is about 40 to 60 watts/gallon.

Figure 2:
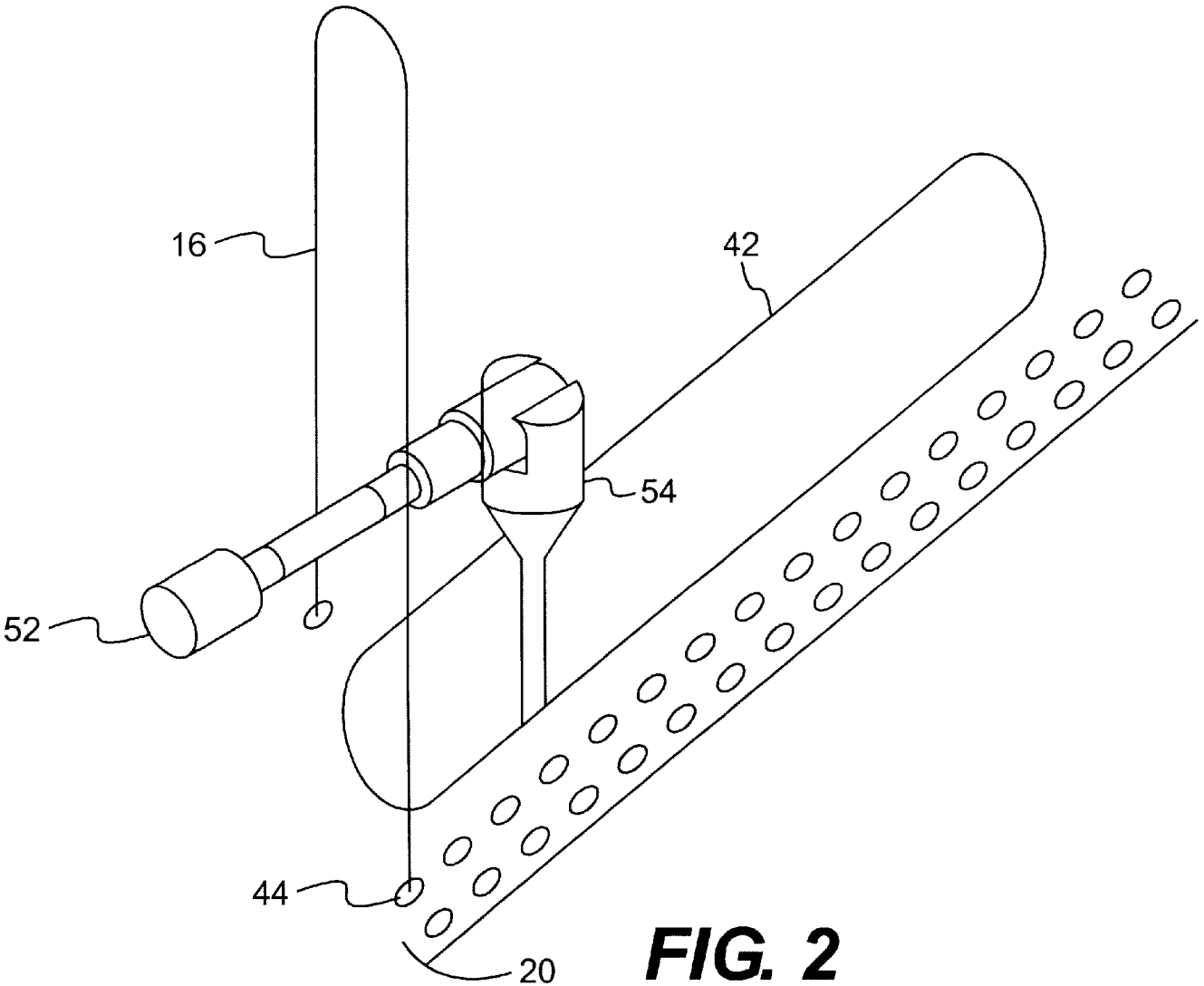
FIG. 2 is a perspective representation of a movable ultrasonic transducer extending through a tube support plate of a steam generator of FIG. 1.

U.S. Pat. No. 4,537,511 is incorporated by this reference for its disclosure of the design of transducer arrays. Other transducers which can be mobilized and can output as much or more energy may also be employed. For example, sonotrodes having one transducer at the end of a resonating rod may be employed.

Where a transducer 52 must be introduced into steam generator 10 through a relatively small diameter nozzle such as nozzle 46 and then manipulated through vessel internals to the surfaces which need to be cleaned, such as tubes 16 of a tube bundle extending vertically from a horizontal tubesheet 18 with spaced tube support plates 20 above the tubesheet 18, the transducer 52 may be manipulated by a robotic device 54 such as the delivery device of U.S. Pat. No. 5,265,129 (known in the electric power industry as a SID robot) or the assignee's sludge lance rail system of U.S. Pat. No. 5,069,172, which patents are hereby incorporated by this reference for their disclosure of the structure and use of these deployment devices. These delivery devices were designed originally to manipulate cameras, cleaning heads and sludge lances in steam generators and can be readily adapted to carry a transducer 52 or array of transducers. Other robotic systems are disclosed by U.S. Pat. Nos. 5,036,871; 5,564,371; and U.S. SIR H1,115. Advantageously, a rail or other device for delivering a transducer 52 in order to introduce high energy at high frequencies (and therefore, inducing low displacements) can sufficiently stabilize the transducer 52 so that the transducer 52 will not need to be fixedly attached to the steam generator 10. FIG. 2 shows a delivery device 54 extending through a flow slot 42 in a tube support plate 20. The flow slot 42 may be any one of up to six or more flow slots along the center tube lane and may have a width of about 5 inches or more and a length of about 14 inches or more. In practices where relatively high power levels are employed, it may be desirable to stabilize the transducer assembly at an intermediate location by one of the tube support plates in a manner similar to that indicated in U.S. Pat. No. 5,564,371. Advantageously, a delivery device can move the transducer 52 (or a transducer array) between the hot legs and cold legs of tubes 16 along the center of a tube lane in a U-tube bundle of steam generator 10.

Optionally, a reflector shield (not shown) may be employed above or adjacent to the transducer 52 (or transducer array) to provide a preferential distribution of the wave energy downwards toward the tubesheets and radially outwardly into the tube bundle. An effective reflector shield may have a chevron or "V" shaped foil body with a gas filled interior. A less effective shield may simply be fabricated of metal plates. Similarly, a reflector shield (not shown) may be employed in the upper bundle area above the tube support sheets, if desired.

In one practice of the present invention, one or more chains 53 of transducers 52 (as is shown in FIG. 1) may be suspended within a steam generator from the uppermost tube support plate 20 or higher in the steam generator and then mounted (and later dismounted) by a robot separately introduced into the steam generator through a small diameter nozzle for enabling a large transducer array to be assembled in situ and employed to clean the upper bundle regions of the steam generator. In some steam generators, additional nozzles 46 (not shown) are available at upper portions of the lower portion 12 to permit access for such deployment. FIG. 1 shows a long chain 53 extending between end plates 55 and 56 installed at flow slots by a robot operating in the same or adjacent flow slots (not shown). The transducers 52 may be located above the tube support plates 20 (as generally shown) or in the flow slots 42 as shown by transducer 57. In another practice, the lower plate 56 may be replaced by a plumb (not shown) and the chain 53 suspended from the upper plate 55. A chain 53 with a plumb may be advantageously employed to clean crevices around tubes in steam generator designs where multiple tubes extend through enlarged holes in tube support plates as disclosed, e.g., by U.S. Pat. No. 4,143,709. If desired, the chain 53 may remain in the steam generator during on-line operation and later employed during the next shutdown. Preferably, the transducers 52 are connected by eyelets or other suitable flexible connectors. To clean the region above one of the tube support plates 20, three to four chains of up to about four or more 1000 (or more powerful) watt transducers 52 each may be suspended in the tube lane in the center of the tube bundle above the upper surface of the tube support plate 20 in order to introduce a total of up to about 20–60 watts/gallon or more into the liquid. Advantageously, large transducer arrays which could not be introduced through small diameter nozzles, can be introduced in subassemblies by the delivery device, manipulated through the tube support plates 20 and then assembled (and disassembled afterward) in situ and be employed to clean the upper bundle regions of steam generators in shorter time periods. FIG. 1 also shows a transducer 52 (which could be a chain of transducers 52) with a plumb 59 suspended from a tubesheet 18 into a channel head 22 for cleaning the channel head.

After the transducer 52 is introduced into steam generator 10 through a small nozzle 46 near the tubesheet 18, the nozzle 46 is sealed and a liquid such as water or an aqueous solution then is introduced into the steam generator 10 so that at least a portion of the tubes 16 and the tubesheet 18 are submerged in the liquid. If a tube support plate 20 is to be cleaned, then it should be submerged as well. In one practice of the present invention where all of the tube support plates 20 are to be cleaned, it is preferable to clean the uppermost tube support plate 20 first and then lower the liquid level to the next lower tube support plate 20 and clean that tube support plate 20 and so on down to the tubesheet 22 so that the dislodged scale and sludge can be washed downwardly. In an alternative practice, several or even all support plates 20 may be cleaned simultaneously or one or more tube support plates 20 and a tubesheet 18 may be simultaneously cleaned. Advantageously, the primary side of the steam generator 10 may be filled with a gas (air or nitrogen) so that a film or scale on the primary side is not disturbed by a cavitating liquid. In one practice, the pressure in the steam generator is increased, for instance, by introducing air or inert gas (i.e., nitrogen) into the steam generator34. When pressurized to several bar or more, cavitation at the surface of the transducers is suppressed thereby increasing the penetration of the ultrasonic energy into the tube array or through the channel head. Further, the temperature of the water or cleaning agent may be controlled, preferably to 35° C. or lower, to achieve the same effect. Finally, the water or cleaning agent may be degassed by applying a vacuum to the steam generator 34. Degassing the liquid medium improves the cleaning action of the invention.

In another practice of the present invention, ultrasonic energy may be generated while moving the transducer 52 or transducer array either continuously or stepwise relative to the tubes 16 and tube support plates 20 or tubesheet 18. Alternatively, and if desirable at high power levels, the transducer 52 (or array of transducers) may be moved from an initial position to a subsequent position between the periods when energy is introduced into the liquid in order to suitably support the delivery device near the transducer 52 or transducer array, e.g., as disclosed by U.S. Pat. No. 5,564,371. Advantageously, moving the transducer 52 (or transducer array) moves the ultrasound nodes so that the adjacent surfaces and crevices and also surfaces of tubes and crevices in the interior rows in the bundle are exposed to maximum sonic energy nodes. In a preferred practice, the transducer 52 or transducer array moves at a nominal velocity of at least about 0.1 inch/minute (2.5 mm/minute) when introducing ultrasonic energy into the liquid. Advantageously, the radial transducers may introduce up to about 500 Gs or more of low amplitude energy into the liquid without damaging the tubes, tubesheet welds or other internal structures of the steam generator.

Generally, in practices employing arrays of transducers 52, the transducers 52 operate at the same frequency. In certain practices, whether employing arrays of transducers 52 supported by a fixture or delivered and manipulated by robots, rail, or the like, two of the transducers 52 may simultaneously operate at different frequencies in order to achieve more effective scale disruption. For example, one transducer 52 in an array may operate at about 25 kHz while another transducer 52 operates at about 40 kHz. The particular frequencies in any application will depend upon the location of the scale or sludge (i.e., in crevices between tubes and tubesheets or support plates, on exposed surfaces like the free span tube surfaces or in the "shadow" zones). In addition, operating conditions such as deposit morphology and particle size may have an effect.

Because the transducers 52 produce high amplitude wave energy by standing waves, the energy field is non-uniform along the length of a transducer's resonator. However, the non-uniformity of the energy field around a transducer tends to decrease with distance from the resonator because of wave diffraction as well as scattering and reflection within the tube bundle. By using different frequencies, the effects of an initially non-uniform energy field may be substantially overcome and a more even pattern of bubble formation and collapse may be produced.

At lower frequencies the bubbles have more time to grow before they collapse, so that they will collapse with a greater force and release more energy. Also, there is less "shadowing" at lower frequencies because shadows are not produced until the object in the energy field is the same size as the wave length (which is 2.4 inches at 25 kHz and 1.5 inches at 40 Khz). Because the tube diameters are less than one inch and therefore smaller than the wave length, shadowing is unlikely to significantly adversely affect the disruption of steam generator deposits. Further, the simultaneous use of different frequencies can reduce the "transparency" of relatively large internal components of a steam generator, such as tube support plates and flow distribution baffles. At higher frequencies wave diffraction tends to increase because the wavelength becomes shorter. Thus, the cleaning of deposits from behind the tubes tends to be more effective at 40 kHz than at 25 kHz.

Advantageously, if the energy field in a steam generator is sufficiently uniform, the transducers 52 need not be moved in order to align the wave antinodes with the spaces between the columns of tubes. Thus, the cleaning time may be substantially reduced; and in some cases reduced up to about 25% of the "energized" cleaning time.

In addition, the different frequencies may be tuned to overlay their node patterns. For example, the antinodes at 25 kHz are 1.2 inches apart and the antinodes at 40 kHz are 0.75 inch apart. Thus, the node patterns may be overlaid at the half wave frequency of the longer wave, e.g., every other antinode of the 40 kHz transducer 52 may be synchronized with each antinode of the 25 kHz transducer 52 tuned to 20 kHz.

The present invention may be employed with water and with aqueous solutions containing scale conditioning agents as disclosed by U.S. Pat. Nos. 5,841,826 and 5,764,717 or chemical cleaning agents as disclosed by U.S. Pat. Nos. 5,194,223 and 5,368,775, which are incorporated by this reference for the use of such chemicals. Preferably, the water and aqueous solutions are degassed as the presence of dissolved gas would require additional energy. The present invention may also be employed as one of several steps in a cleaning process which includes such traditional hydraulic cleaning methods as sludge lancing, pressure pulsing, upper bundle hydraulic cleaning and high volume bundle washing as disclosed by U.S. Pat. Nos. 4,079,701; 4,276,856; 4,273,076; 4,655,846; 4,699,665; 5,154,197 and 5,564,371, which are incorporated by this reference for their discussion of such practices.

In addition to cleaning shell and tube heat exchangers such as steam generators 10, the present invention may be employed to clean the surfaces of internal structural members of other vessels and similar containers such as tanks, pumps, pipes and the like. Further, a vessel may contain portable assemblies which have previously been exposed to high temperature water or steam.

While a present preferred embodiment of the present invention has been shown and described, it is to be understood that the invention may be otherwise variously embodied within the scope of the following claims of invention.

What is claimed is:

1. An ultrasonic cleaning method for cleaning a film, scale or sludge from a surface of a shell and tube heat exchanger, wherein the shell and tube heat exchanger comprising a shell, a concentric wrapper within the shell, and a plurality of tubes within the wrapper, wherein each of the plurality of tubes having a primary side on an interior of the tube and a secondary side on an exterior of the tube, wherein each of the plurality of tubes being supported by at least one tube support plate, the method comprising:

positioning an ultrasonic transducer having an external surface adjacent the secondary side such that the ultrasonic transducer is located within a circumference of the concentric wrapper, wherein the secondary side having been previously exposed to at least one of water and steam at temperatures of about 200° C. or more, wherein the exposed surface of the secondary side is at least partially covered by the film, scale or sludge;

submerging the ultrasonic transducer and at least a portion of the tube secondary side surface in a liquid; and generating ultrasonic energy at a power level in a range of about 20 watts/gallon to 60 watts/gallon near the transducer external surface and at a frequency of from about 10 KHz to about 200 KHz for introducing the ultrasonic energy into the liquid.

2. The ultrasonic cleaning method of claim 1, wherein the ultrasonic energy is generated at a power level of at least about 10 watts/inch$^2$ (1.55 watts/cm$^2$) near the transducer external surface.

3. The ultrasonic cleaning method of claim 2, wherein the ultrasonic energy is generated at a power level from about 15–40 watts/inch$^2$ (2.33–6.2 watts/cm$^2$).

4. The ultrasonic cleaning method of claim 1, further comprising;

positioning the ultrasonic transducer in the shell and tube heat exchanger before submerging the ultrasonic transducer in the liquid.

5. The ultrasonic cleaning method of claim 4, wherein a chain of ultrasonic transducers are suspended in the shell and tube heat exchanger within the circumference of the wrapper.

6. The ultrasonic cleaning method of claim 1, wherein an ultrasonic transducer is disposed in a slot in a plate within the circumference of the wrapper for cleaning the plate.

7. The ultrasonic cleaning method of claim 1, wherein the ultrasonic transducer is introduced into a tube lane in a tube bundle extending from a tubesheet within the circumference of the wrapper.

8. The ultrasonic cleaning method of claim 7, wherein the ultrasonic transducer is introduced into a tube bundle between spaced apart tube support plates.

9. The ultrasonic cleaning method of claim 1, further comprising:

moving the ultrasonic transducer before generating ultrasonic energy;

again moving the ultrasonic transducer after generating ultrasonic energy; and again generating ultrasonic energy at a power level of at least about 10 watts/inch$^2$ (1.55 watts/cm$^2$) near the transducer external surface and at a frequency of from about 10 KHz to about 200 KHz for introducing the ultrasonic energy into the liquid.

10. The ultrasonic cleaning method of claim 1, further comprising:

moving the transducer through the liquid as the transducer introduces energy into the liquid.

11. The ultrasonic cleaning method according to claim 1, further comprising:

interrupting the ultrasonic energy;

moving the ultrasonic transducer through the liquid; and again introducing ultrasonic energy into the liquid with the ultrasonic transducer.

12. The method of claim 11, wherein the transducer moves through the liquid between the energy introducing steps.

13. The method of claim 11, wherein a transducer array is introduced into the shell and tube heat exchanger through a nozzle on a delivery device for moving the transducer through the liquid in two directions.

14. The method of claim 11, wherein the liquid is an aqueous solution comprising a scale conditioning agent or a chemical cleaning agent.

15. The method of claim 11, further comprising:

positioning a delivery robot into the shell and tube heat exchanger separately from the ultrasonic transducer; and mounting the ultrasonic transducer on the delivery robot in the shell and tube heat exchanger before introducing ultrasonic energy into the liquid.

16. The method of claim 1, further comprising:

performing one of pressure pulse cleaning, high volume tube bundle washing, upper tube bundle hydraulic cleaning and sludge lancing.

17. The ultrasonic cleaning method according to claim 1, further comprising:

suspending the ultrasonic transducer in the vessel.

18. The ultrasonic cleaning method of claim 17, wherein a chain of transducers is suspended in the vessel.

19. An ultrasonic cleaning method, comprising:

positioning an ultrasonic transducer into a shell and tube heat exchanger containing surfaces previously exposed to at least one water and steam at a temperature of about 200° C. or more;

submerging the ultrasonic transducer and at least a portion of the shell and tube heat exchanger surface in a liquid;

introducing ultrasonic energy into the liquid with the ultrasonic transducer;

moving the ultrasonic transducer through the liquid, wherein the transducer moves through the liquid while introducing ultrasonic energy into the liquid.

20. The method of claim 19, wherein the transducer moves at a velocity of at least about 0.1 inch/minute while introducing ultrasonic energy into the liquid.

* * * * *